US007030898B2

(12) United States Patent
Tsubota

(10) Patent No.: US 7,030,898 B2
(45) Date of Patent: Apr. 18, 2006

(54) THERMAL PRINTER AND CONTROL METHOD OF CONTROLLING COOLING FAN

(75) Inventor: Keiji Tsubota, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 138 days.

(21) Appl. No.: 10/850,384

(22) Filed: May 21, 2004

(65) Prior Publication Data

US 2004/0233269 A1 Nov. 25, 2004

(30) Foreign Application Priority Data

May 21, 2003 (JP) ..... 2003-143762

(51) Int. Cl.
*B41J 29/377* (2006.01)

(52) U.S. Cl. ..... 347/223; 347/18

(58) Field of Classification Search ..... None
See application file for complete search history.

(56) References Cited

U.S. PATENT DOCUMENTS 6,324,361 B1 * 11/2001 Itoh et al. ..... 399/92
2003/0156147 A1 * 8/2003 Misumi ..... 347/17

FOREIGN PATENT DOCUMENTS

| | | | |
|---|---|---|---|
| JP | 6-042494 A | | 2/1994 |
| JP | 06-255141 A | | 9/1994 |
| JP | 9-62168 | * | 3/1997 |
| JP | 2004-345319 | * | 12/2004 |

* cited by examiner

*Primary Examiner*—Huan TRan
(74) *Attorney, Agent, or Firm*—Sughrue Mion, PLLC

(57) ABSTRACT

A color thermal printer is provided with a cooling fan for cooling a thermal head and a fan rotational speed controller for controlling the rotation speed of the cooling fan, a head temperature sensor for measuring a temperature of the thermal head and an environmental temperature sensor for measuring an environmental temperature around the thermal head. A controller predicts the head temperature in each recording position based on the printing rate (printing density) calculated from the image data, a measured temperature of the thermal head and a measured environmental temperature, and also predicts a delay time of a heat transmitting system and a measuring system based on a fluctuation of the printing rate. The controller controls an air amount of the cooling fan in each recording position based on the predicted temperature and the delay time.

12 Claims, 6 Drawing Sheets

THERMAL PRINTER AND CONTROL METHOD OF CONTROLLING COOLING FAN

BACKGROUND OF THE INVENTION

1. Field of the Invention

The present invention relates to a thermal printer having a cooling fan for cooling a thermal head and a control method of controlling the cooling fan.

2. Description of the Prior Arts

A thermal printer is provided with a thermal head in which plural heating elements are arranged in rows in a main scanning direction. An image is printed on a recording paper by heating the heating elements that are contacted with a surface of the recording paper while feeding the recording paper in a sub-scanning direction. In order to obtain a high quality image, the temperature of the thermal head (hereinafter referred to as the head temperature) needs to be kept appropriately. However, if printing is continuously performed, it is caused to accumulate heat in the thermal head, so that it becomes impossible to print the image of which density is appropriate. In order to prevent the heat accumulation in the thermal head, a heat sink for radiating heat is provided in the thermal head and controlled by a cooling fan.

In a commercial thermal printer, an air amount of the cooling fan is not controlled. Accordingly, the air amount is constant during driving the cooling fan. Therefore, for example, when a white solid image such as a snow scene and a black solid image such as a night scene are printed alternately and continuously, in printing the white solid image, the head temperature becomes low due to a low printing rate (printing density); meanwhile, in printing the black solid image, the head temperature becomes high due to a high printing rate. As a result, the head temperature gradually increases or decreases repeatedly up and down in response to cooling ability of the cooling fan.

The change of the head temperature in one printing period is shown in FIG. 4. A printing image in which a white (blank) solid area and a black solid area are arranged alternately is shown in FIG. 4(*a*). A state that the cooling fan is continuously driven in printing the black and white solid areas is shown in FIG. 4(*b*). The change of the head temperature measured by a measurer such as a thermography is shown in FIG. 4(*c*). The head temperature becomes high when printing the black solid area, while the head temperature becomes low when printing the white solid area. In such printing, since the air amount of the cooling fan is large, the head temperature gradually becomes low during changing a corrugated form. If the air amount is small, the head temperature gradually becomes high during changing the corrugated form. Therefore, density unevenness is created in the same print, and to make matters worse, density difference is generated between prints. In addition, if the printer is placed in a high or low temperature environment, the cooling ability of the cooling fan is changed. Therefore, the change of the head temperature becomes large, so that the density difference is generated from the difference in environments.

In order to solve the above-mentioned problems, in the thermal printer disclosed in Japanese Patent Laid-Open Publication No.H6-255141, the head temperature sensor for measuring the head temperature is provided in the thermal head to control the head temperature by controlling the air amount of the cooling fan based upon the measured temperature information from the sensor. In the thermal printer disclosed in Japanese Patent Laid-Open Publication No.H6-42494, the head temperature is controlled by controlling the air amount of the cooling fan based upon the measured temperature information from the head temperature sensor, applying the fuzzy theory.

However, the head temperature is not enough to be controlled by the above-mentioned methods. If the two images having different printing rates, for example the black and white solid areas, are printed alternately or randomly, the head temperature is fluctuated. For example, when the black and white solid areas are printed alternately as shown in FIG. 5(*a*), the actual temperature of the thermal head is fluctuated as shown in FIG. 5(*b*). However, with respect to the fluctuation of the head temperature measured by the head temperature sensor, delay of $\Delta t$ minutes occurs to the fluctuation of the actual head temperature.

This delay time is caused by a delay in both a heat transmitting system and a measuring system. The delay in the heat transmitting system is attributable to an attachment position of the head temperature sensor, material of the thermal head and a heat sink, and a shape of an air flowing path for leading a cooling air sent from the cooling fan, while the delay in the measuring system is attributable to timing of temperature data acquisition in the head temperature sensor. When the actual head temperature is changed, it takes several seconds to several tens of seconds to detect such temperature change by the head temperature sensor. Accordingly, as shown in FIG. 5(*d*), the control of the cooling fan is delayed. For example, if the black and white solid areas are printed alternately in the same printing paper, although the actual head temperature is lowered when printing the white solid area, it takes considerable time to reflect in the control of the air amount of the cooling fan after measuring such temperature change by the head temperature sensor. Therefore, when the air amount is controlled, the black solid area has already started to be printed.

When the black solid area is printed, since the air amount is kept low, the actual head temperature becomes high. When the air amount increases after detecting the temperature change by the head temperature sensor, the white solid area has already started to be printed, so that there is a problem that the actual head temperature is rapidly lowered. Accordingly, since the control of the air amount of the cooling fan is delayed according to the kind of image to be printed, the fluctuation of the head temperature is not enough to be controlled, so that the density difference between prints and the density unevenness in the same print are created.

SUMMARY OF THE INVENTION

An object of the present invention is to provide a thermal printer for controlling a thermal head in an appropriate temperature by use of a cooling fan according to the kind of an image to be printed, and a control method of controlling the cooling fan.

In order to achieve the above object, a thermal printer of the present invention controls an air amount of a cooling fan based upon-an estimated temperature of a thermal head after estimating a head temperature in each recording position on the basis of a printing rate (printing density) determined from image data. In addition, the air amount in each recording position is controlled in consideration of a delay time for measuring the head temperature.

According to the preferred embodiment of the present invention, the thermal printer includes a first temperature sensor for measuring a head temperature and a second temperature sensor for measuring an environmental temperature around a thermal head. A controller estimates a temperature in a recording position where heating elements of the thermal head are pressed onto a recording material, based on first, second and third data tables or first, second and third operational mathematical expressions, and controls the air amount of the cooling fan in view of the delay time. The first table data or operational mathematical expression shows a relation between the printing rate and a temperature rising amount of the thermal head to the head temperature. The second table data or operational mathematical expression shows a relation between difference between the head temperature and the environmental temperature and a temperature dropping amount of the thermal head to the air amount of the cooling fan. The third table data or operational mathematical expression shows a relation between a fluctuation amount of the printing rate and the delay time of a heat transmitting system and a measuring system.

According to the present invention, after estimating the head temperature in each recording position based on the printing rate determined from the image data, the air amount of the cooling fan is controlled on the basis of the estimated result, so that it is possible to control the air amount in response to the fluctuation of the head temperature. Thus, the head temperature can be stabilized near the target temperature. As a result, density difference between prints and density unevenness in the same print can be prevented.

BRIEF DESCRIPTION OF THE DRAWINGS

The above and other subjects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE PREFERRED EMBODIMENTS

Figure 1A:
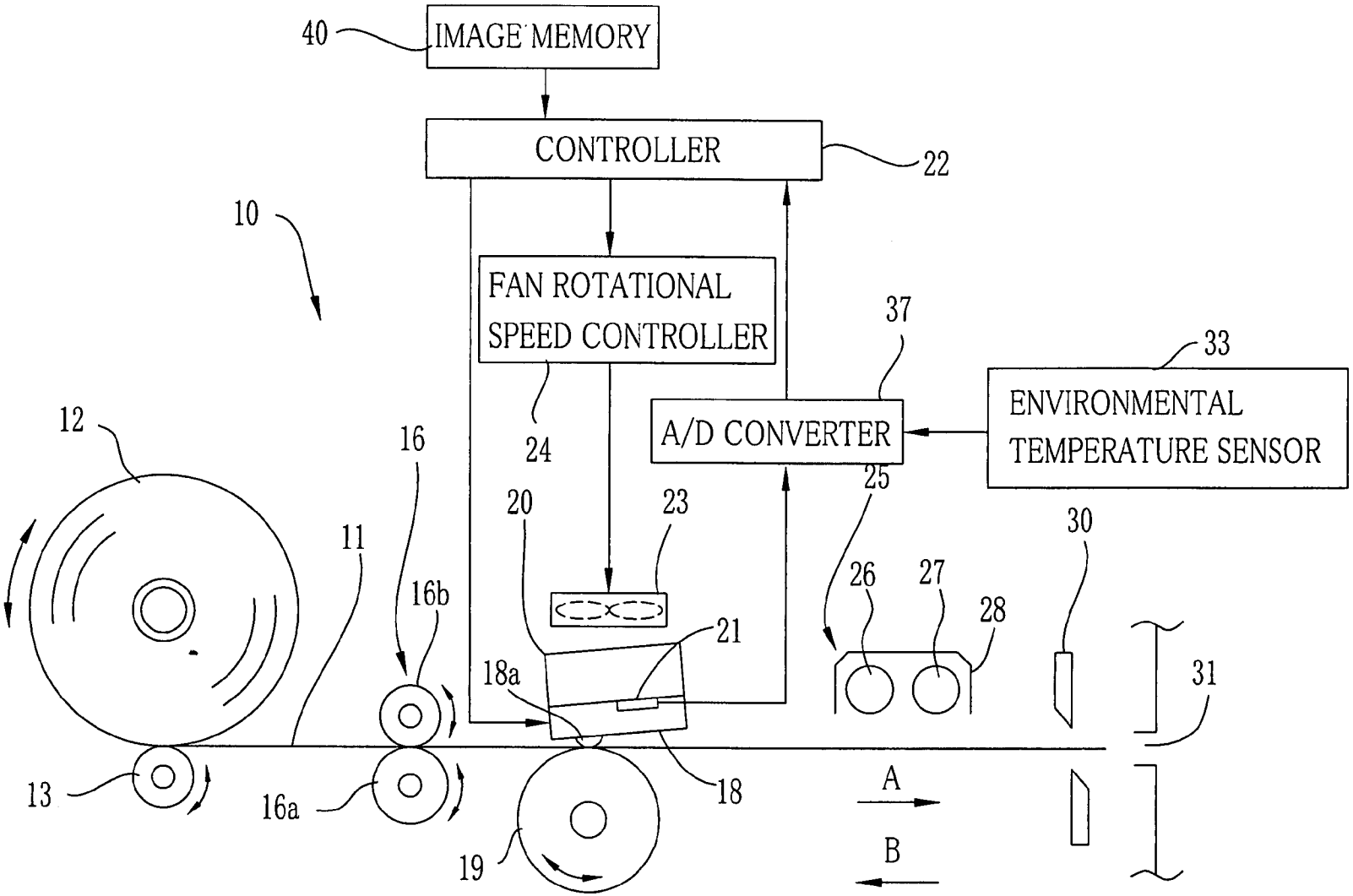
FIG. 1A is a schematic view of a color thermal printer to which the present invention is applied.

In FIG. 1, a continuous color thermal recording paper 11 (hereinafter referred to as a recording paper) is used in a color thermal printer 10 as a recording media. The recording paper 11 is wound into a roll shape and loaded into the color thermal printer 10 as a recording paper roll 12.

A feeder roller 13 for supply is in contact with an outer periphery of the recording paper roll 12. The feeder roller 13 is driven by a feeding motor (not shown). When the feeder roller 13 rotates in a clockwise direction, the recording paper roll 12 is rotated in a counter clockwise direction to feed the recording paper 11 from the recording paper roll 12. Whereas, when the feeder roller 13 is rotated in the counter clockwise direction, the recording paper roll 12 is rotated in the clockwise direction to withdraw the recording paper 11 thereto.

As well-known, the recording paper 11 includes a cyan thermosensitive coloring layer, a magenta thermosensitive coloring layer, and a yellow thermosensitive coloring layer overlaid on a support medium in sequence. The yellow thermosensitive coloring layer, which is the farthest from the support medium, has the highest heat sensitivity and develops the yellow color by application of relatively low heat energy. The cyan thermosensitive coloring layer, which is the closest to the support medium, has the lowest heat sensitivity and develops the cyan color by application of relatively high heat energy. In addition, the yellow thermosensitive coloring layer loses its coloring ability when near-ultraviolet rays of a wavelength peaking at 420 nm are applied thereto. The magenta thermosensitive coloring layer develops the magenta color in heat energy between the necessary energy for coloring the yellow and cyan thermosensitive coloring layers, and loses its coloring ability when ultraviolet rays of a wavelength peaking at 365 nm are applied thereto.

Feeder roller pairs 16, which feed the recording paper 11 while nipping it, are disposed near the recording paper roll 12. The feeder roller pairs 16 are constituted of a capstan roller 16*a*, which is rotated by the feeding motor (not shown) and a pinch roller 16*b* pushing against the capstan roller 16*a*. The recording paper 11 is reciprocally fed in the advancing direction (A direction) and in a withdrawing direction (B direction).

A thermal head 18 and a platen roller 19 are disposed on the downstream side in the A direction of the feeder roller pairs 16 so that a feeding path for the recording paper 11 lies between those. The thermal head 18 is disposed above the feeding path of the recording paper 11, and has a heating element array 18*a* which includes a large number of heating elements arranged linearly in a main scanning direction. A heat sink 20 for dissipating heat is attached to the thermal head 18, and a head temperature sensor 21 for measuring the temperature of the thermal head 18, for example a thermistor, is buried therein. The temperature of the thermal head 18 is measured by the head temperature sensor 21, and then sent to a controller 22 as a head temperature signal.

The controller 22 reads one line of the signal of a color image to be recorded from an image memory 40, and then converts one line of the signal to one line of driving data. The driving data is sent to the thermal head 18. After each heating element is driven by one line of the driving data, heat energy in accordance with the density of each pixel is generated. The heating element array 18*a* is driven to generate heat at the predetermined temperature while the recording paper 11 is fed by the feeder roller pairs 16 line by line, so that the specified thermosensitive coloring layer develops color. The platen roller 19 is rotated in response to the feeding of the recording paper 11.

A cooling fan 23 is provided above the thermal head 18, and sends cooling air to the heat sink 20. If the temperature is raised by heat accumulation in the thermal head 18 during printing, the heat is transmitted to the heat sink 20, and then dissipated and removed by the cooling air from the cooling fan 23. Namely, the heat sink 20 and the cooling fan 23 are used as a cooling device for cooling the thermal head 18. The air amount of the cooling fan 23 is adjusted by changing a pitch of the blade or controlling of the rotation speed of the cooling fan 23. The rotation speed can be controlled by controlling duty (rate of ON-time period within a unit time) of driving pulse for example. In this embodiment, a fan rotational speed controller 24 adjusts the air amount by controlling the rotation speed of the cooling fan 23 so that the temperature of the thermal head 18 is controlled.

An optical fixer 25 is disposed on the downstream side in the A direction of the thermal head 18 so as to face the recording surface of the recording paper 11. The optical fixer 25 is constituted of a yellow fixing lamp 26, a magenta fixing lamp 27 and a reflector 28 and so forth. The yellow fixing lamp 26 emits near-ultraviolet rays of which the wavelength peaks at 420 nm to fix the yellow thermosensitive coloring layer of the recording paper 11. The magenta fixing lamp 27 emits ultraviolet rays of which the wavelength peaks at 365 nm to fix the magenta thermosensitive coloring layer.

A cutter 30 and an exit opening 31 are disposed one by one on the downstream side in the A direction of the optical fixer 25. The cutter 30 is operated to cut the continuous recording paper 11 every recording area. The recording paper 11 cut into a sheet is discharged from the exit opening 31.

Furthermore, the color thermal printer 10 is provided with an environmental temperature sensor 33. An environmental temperature measured by the environmental temperature sensor 33 is sent to the controller 22 as an environmental temperature signal.

As well-known, the controller 22 is constituted of a CPU, a memory and so forth, and controls the overall operation of the printer. In addition to the fan rotational speed controller 24 and an A/D converter 37, an operation panel, a feeding motor driver, a head driver, a lamp driver and so forth (not shown) are connected to the controller 22. The controller 22 sends a driving control signal to each driver in response to the input signal from the operation panel, and then controls the cooling fan 23, the thermal head 18, fixing lamps 27, 28 and so forth.

The head temperature sensor 21 and the environmental temperature sensor 33 are connected to the controller 22 through the A/D converter 37. The analog temperature signal measured by the head temperature sensor 21 and the environmental sensor 33 is converted to the digital signal by the A/D converter 37. The digital signal is sent to the controller 22 as temperature data.

Figure 1B:
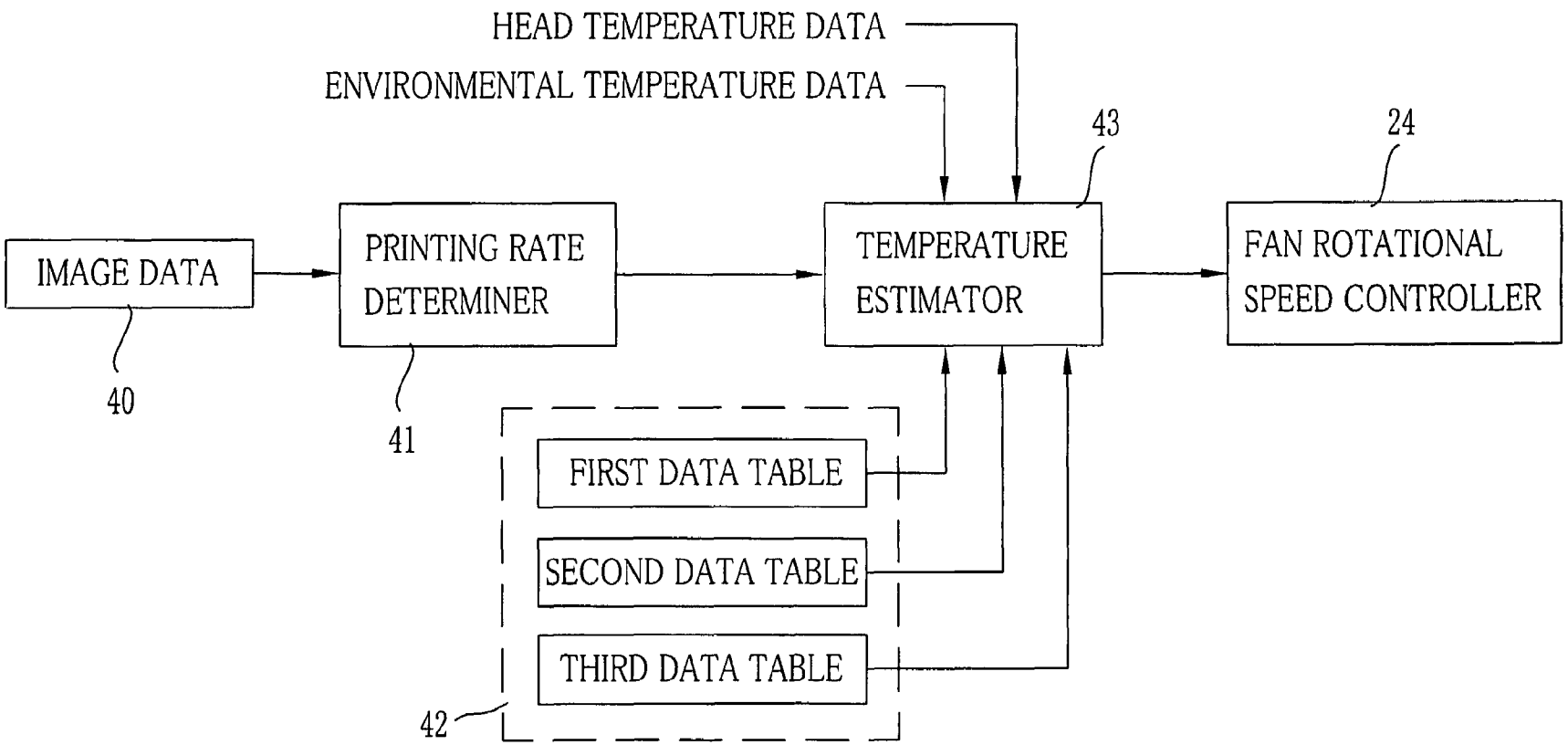
FIG. 1B is a functional block view of a controller.

FIG. 1B shows a function of the controller 22. A printing rate determiner 41 to output information of printing density calculates the printing rate (printing density) from one line of the image data to be recorded. The printing rate is a value associated with an average value of one line of the image data. For example, if average printing rate of all pixels on one line is 50% (the min. density is 0% and the max is 100%), the printing rate is 50%. The printing rate is also called a blackening rate in the black and white printing. If plural lines are merged into a single area, the printing rate may be calculated every area.

A temperature estimator 43 predicts the temperature at a contact position between the heating element array 18*a* and the recording paper 11, that is the actual temperature of the thermal head 18 in each recording position (recording line or area), based on the printing rate calculated by the printing rate determiner 41. In order to estimate the temperature, first and second data tables are stored in a memory 42. The first data table is used for predicting a head temperature increase, while the second data table is used for predicting a head temperature decrease. Further, a third data table used for predicting a delay time of the above-mentioned heat transmitting system and measuring system is stored in the memory 42.

Figure 3A:
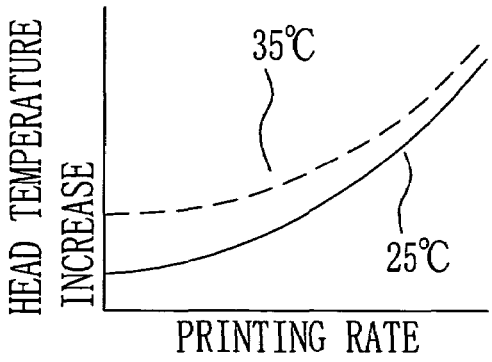
FIG. 3A is a characteristic curve showing a relation between a printing rate and a temperature increase.
Figure 3B:
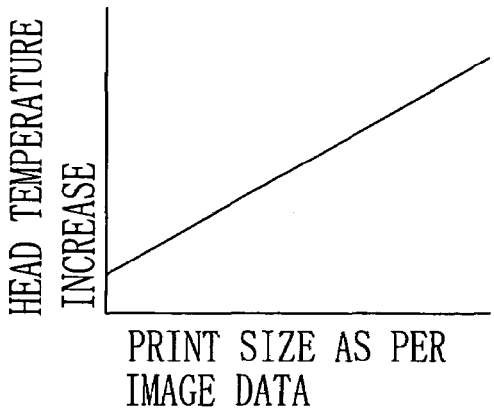
FIG. 3B is a characteristic curve showing a relation between an image size and the temperature increase.

The first data table is used for predicting the head temperature increase based on the printing rate and the measured temperature of the thermal head 18. The example is graphed as shown in FIG. 3A. The head temperature increase depends on the temperature of the thermal head 18 before printing and the printing rate. If the printing rate becomes high, the head temperature increase tends to become large. Accordingly, in the first data table, for example, when the temperature of the thermal head 18 is graduated at steps of 10 degrees, the printing rate at plural levels of the head temperature and the head temperature increase are made to correspond with each other. In the present embodiment, the printing in the same print size is explained. But if the print size is changed, the head temperature increase may be calculated after calculating the relation between the head temperature increase and size (print size) or pixel range of the image data as shown in FIG. 3B. Furthermore, the printing rate including the change of the print size may also be used.

Figure 3C:
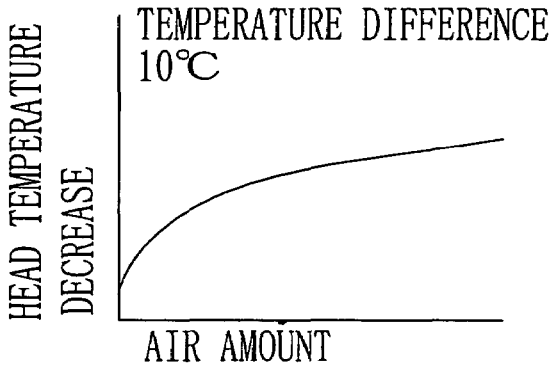
FIGS. 3C and 3D are characteristic curves showing a relation between the air amount and a temperature decrease.
Figure 3D:
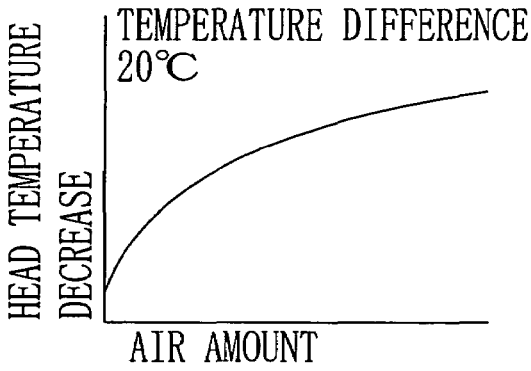

The second data table is used for predicting the head temperature decrease based on the air amount of the cooling fan 23 and the temperature difference between the measured temperature of the thermal head 18 and the measured environmental temperature. The example is graphed as shown in FIGS. 3C and 3D. As the temperature difference is larger, the cooling ability of the cooling fan 23 is higher, so that the head temperature decrease tends to become large. In addition, if the air amount increases, the head temperature decrease becomes large. Accordingly, in the second data table, as in the case of the first data table, for example, when the temperature difference is graduated at steps of 10 degrees, the air amount and the head temperature decrease are made to correspond with each other.

Figure 3E:
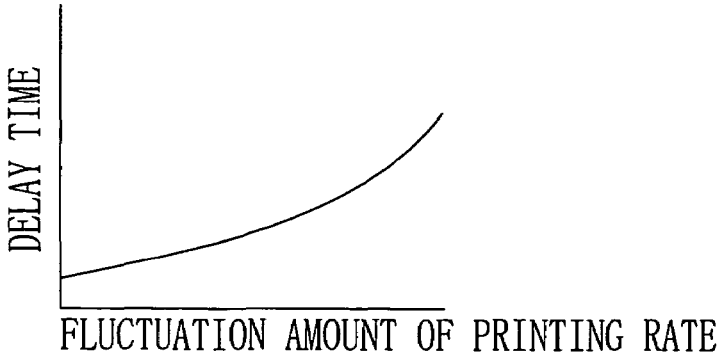
FIG. 3E is a graph showing an example of prediction of a delay time based upon first, second and third data tables.
Figure 4:
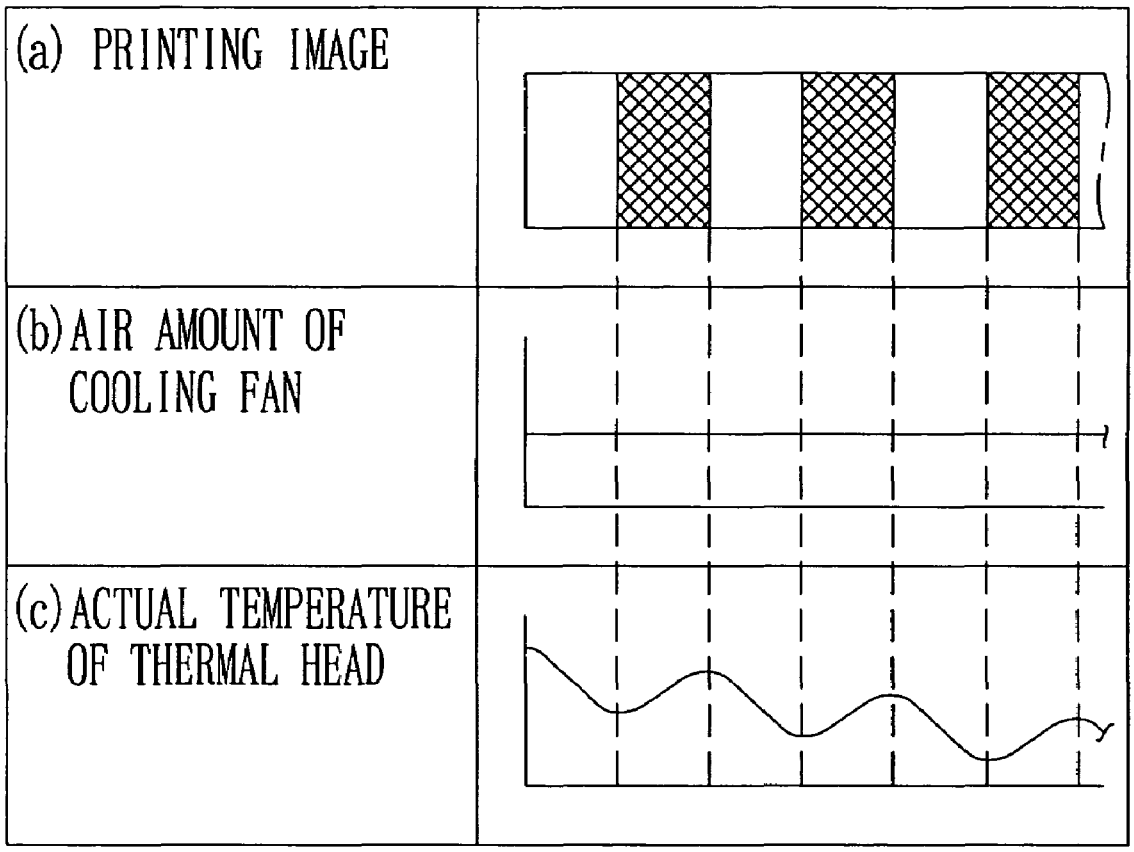
FIG. 4 (PRIOR ART)
FIG. 4 is a view showing a fluctuation of an actual head temperature in a prior art in which an air amount of a cooling fan is constant.
Figure 5:
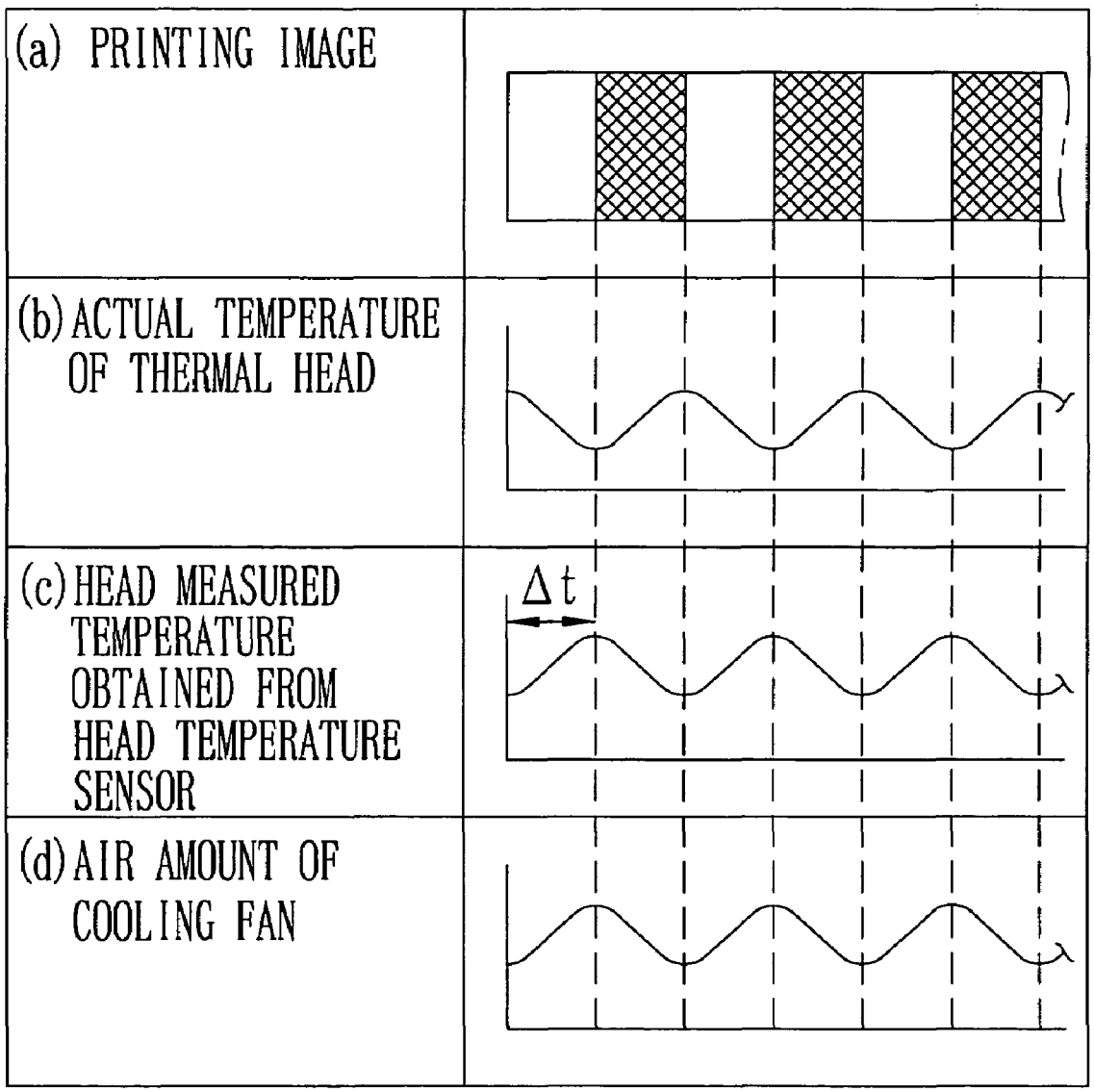
FIG. 5 (PRIOR ART)
FIG. 5 is a view showing a fluctuation between a head temperature measured by a head temperature sensor and an actual head temperature in a prior art in which an air amount of a cooling fan is controlled based on only measured temperature information from the head temperature sensor.

The third data table is used for predicting the delay time of the heat transmitting system and the measuring system based on the fluctuation of the printing rate. The example is graphed as shown in FIG. 3E. As in printing the black and white solid areas, as the printing rate fluctuates more widely, the deviation between the measured temperature of the thermal head 18 and the actual temperature thereof becomes larger, so that the delay time tends to become longer. Therefore, the fluctuation of the printing rate and the delay time are made to correspond with each other in the third data table.

The first, second and third data tables are obtained by experiment or simulation. Moreover, each data table may be obtained by feeding back a device constant, obtained by experiment, to the simulation. In such a case, the accuracy can be raised much more.

Figure 2:
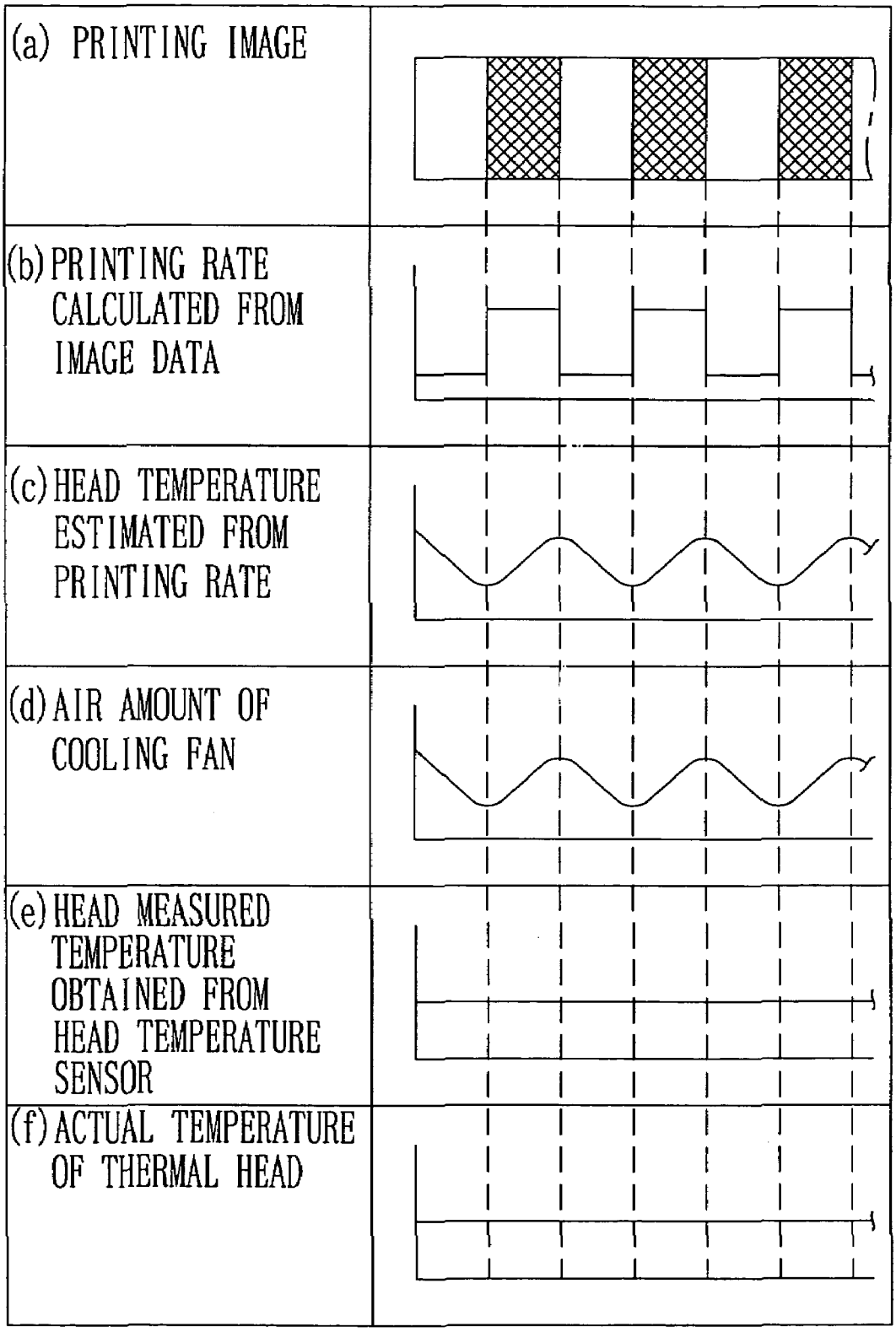
FIG. 2 is a view showing a process for determining an air amount of a cooling fan of the color thermal printer, and showing a fluctuation between a measured head temperature and an actual head temperature when cooling the thermal head.

As shown in FIG. 2(*c*), the temperature estimator 43 predicts the actual temperature of the thermal head 18 in each line or area by use of the first and second data tables, based on the printing rate, the head temperature and the environmental temperature. Subsequently, the delay time is calculated in reference to the third data table, and then the air amount in each recording position is determined in consideration of the delay time. The air amount is controlled by controlling the rotation speed of the cooling fan 23 in each line or area after sending the control signal, which shows the air amount, to the fan rotational speed controller 24. Therefore, the air amount is controlled by shifting the delay time, which is predicted based on the fluctuation of the printing rate (see FIG. 2(*d*)). As a result, the measured temperature and the actual temperature in the thermal head 18 become approximately constant as shown in FIG. 2(*e*),(*f*), so that the density fluctuation is reduced.

The color thermal printer 10 is a one head three-pass type in which recording sheet is fed back and forth three times. As aforementioned, since the cyan thermosensitive coloring layer has the lowest sensitivity, high heat energy is required to develop the cyan color. Accordingly, in printing the cyan image especially, the actual temperature of the thermal head 18 fluctuates widely. Therefore, in the present embodiment, the air amount of the cooling fan 23 is controlled according to the printing rate only when printing the cyan image. If necessary, in printing the yellow and magenta images as well as the cyan image, the air amount can be controlled according to the printing rate.

Next, the operation of the above embodiment is explained. When printing is instructed, the feeding motor (not shown) rotates the feeder roller 13. The feeder roller 13 is rotated in the counter clockwise direction in FIG. 1 to feed the recording paper 11 from the recording paper roll 12. At the same time, controller 22 calculates the printing rate (printing density) line by line from the image data of the image to be printed.

When the recording paper 11 fed from the recording paper roll 12 is nipped by the feeder roller pairs 16, the recording paper 11 drawn from the recording paper roll 12 is fed in the A direction. Subsequently, when the feeder roller pairs 16 are rotated in an opposite direction, the recording paper 11 is fed in the B direction. In feeding the recording paper 11, when a rear end of an image recording area of the recording paper 11 is reached the heating element array 18*a* of the thermal head 18, the heating element array 18*a* is driven to generate heat in response to the yellow image, and then the yellow image is printed in the yellow thermosensitive coloring layer. When printing has been completed, the platen roller 19 is moved to a separating position by a shift mechanism (not shown).

Next, the yellow fixing lamp 26 of the optical fixer 25 is turned on during the recording of the yellow image, while the feeder roller pairs 16 are rotated in the normal direction to feed the recording paper 11 in the A direction. After feeding the recording paper 11, in which the yellow image is recorded, in sequence by the feeder roller pairs 16, the recording paper 11 is stopped when a front end of the image recording area is passed through the optical fixer 25. At the same time, the yellow fixing lamp 26 is turned off. Thereby, the yellow image is fixed. After fixing the yellow image, as in the case of the yellow image, the magenta image is printed while the recording paper 11 is fed in the B direction by the controller 22. The magenta color is fixed by the magenta fixing lamp 27 upon feeding again the recording paper 11 in the A direction. As aforementioned, the actual temperature of the thermal head 18 is less fluctuated in printing the yellow and magenta images. Accordingly, in accordance with the measured temperature information of the thermal head 18 measured by the head temperature sensor 21, the air amount of the cooling fan 23 increases when the head temperature is high, whereas the air amount decreases when the head temperature is low.

Thereafter, the cyan image is printed during feeding the recording paper 11 in the B direction. The controller 22 predicts the temperature of the thermal head 18 in each recording position, that is the fluctuation of the temperature, and the delay time, based on the previously calculated printing rate, each temperature data from both the head temperature sensor 21 and the environmental temperature sensor 33, and the first, second and third data tables previously stored in the memory 42. The controller 22 calculates the air amount in each recording position based on the predicted or estimated temperature fluctuation and delay time to send the control signal showing the air amount to the fan rotational speed controller 24. The fan rotational speed controller 24 controls the air amount of the cooling fan 23 based on the control signal. Thereby, it is possible to control the air amount in response to the fluctuation of the actual temperature of the thermal head 18, so that the actual head temperature can be stabilized near the target temperature. Consequently, the density difference between prints and the density unevenness in the same print which are caused by the fluctuation of the actual head temperature can be prevented.

When the printing of the cyan image has been completed, the recording paper 11 is advanced in the A direction to be cut at a predetermined position by the cutter 30, and then discharged from the exit opening 31. After that, the controller 22 rotates the feeding motor to send the front end of the recording paper 11 in the position of the feeder roller pairs 16. When the color thermal printer 10 is held on standby for the next printing operation, if the next printing is not instructed even if the specific time exceeds, the system controller 22 performs power turn-off operation after rewinding the recording paper 11 to the recording paper roll 12.

According to the present embodiment, although the actual temperature of the thermal head 18 is predicted based on the first, second and third data tables, mathematically expressed operational formulae or equations may be used instead of these data table. Likewise, a first operational equation for calculating the head temperature increase from the printing rate and the measured temperature of the thermal head 18, a second operational equation for calculating the head temperature decrease from the air amount of the cooling fan 23 and the temperature difference between the measured temperature of the thermal head 18 and the measured environmental temperature, and a third operational equation for calculating the delay time of the heat transmitting system and the measuring system from the fluctuation of the printing rate, are previously obtained from the experiment. In printing, the air amount in each recording position is calculated by substituting the printing rate and each temperature data from the head temperature sensor 21 and the environmental sensor 33 into each operational equation.

In the present embodiment, although the color thermal printer is the one head three-pass type in which the color thermal recording paper is fed back and forth three times to record the image, the present invention may be applied to a three head one-pass type in which the color thermal recording paper passes the thermal head once. In the three head one-pass type, the air amount of the cooling fan to the thermal head, which is used for printing the cyan image, is controlled. According to need, the air amount to the other two thermal heads for printing the yellow and magenta images may be controlled.

In addition, the above embodiment is not limited only to the continuous recording paper, but is also applicable to, for example, a sheet of recording paper.

Furthermore, although the color thermal printer is explained as the example, a monochrome thermal printer, a dye sublimation printer, and wax transfer thermal printer may be applied to the present invention.

Although the present invention has been fully described by the way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A thermal printer having a thermal head for printing an image on a recording material by driving a heating element based on image data and a cooling fan for cooling said thermal head, said thermal printer comprising:

a determining unit for determining a printing rate from said image data;

an estimating unit for predicting a temperature in each recording position based on said printing rate, said recording position being where thermal head and said recording material are contacted with each other; and a controller for controlling an air amount of said cooling fan based on said predicted temperature.

2. A thermal printer as claimed in claim 1, further comprising:

a first temperature sensor for measuring a temperature of said thermal head;

a second temperature sensor for measuring a temperature of the environment of printer placement; and wherein said estimating unit determines said predicted temperature in consideration of said head temperature and said environmental temperature.

3. A thermal printer as claimed in claim 2, wherein data tables are stored, and include:

a first data table of a relation data between said printing rate and a rising amount of a temperature of said thermal head to said head temperature;

a second data table of relation data between difference and a dropping amount of a temperature of said thermal head to the air amount of said cooling fan, said difference being between said head temperature and said environmental temperature; and wherein said estimating unit determines said predicted temperature in reference to said first and second data tables.

4. A thermal printer as claimed in claim 3, wherein a third data table is stored, and comprises relation data between a fluctuation amount of said printing rate and a delay time of a heat transmitting system and a measuring system, said air amount in each of said recording positions is calculated in consideration of said delay time.

5. A thermal printer as claimed in claim 2, wherein said estimating unit calculates said predicted temperature from a rising amount and a dropping amount of a temperature of said thermal head, which are obtained by performing a first operational equation and a second operational equation;

said first operational equation calculates said rising amount of said temperature of said thermal head from said printing rate and said head temperature; and said second operational equation calculates said dropping amount of said temperature of said thermal head from the difference between said head temperature and said environmental temperature and the air amount of said cooling fan.

6. A thermal printer as claimed in claim 5, wherein said estimating unit determines said air amount in each of said recording positions in consideration of a delay time obtained by performing a third operational equation for calculating said delay time of a heat transmitting system and a measuring system from a fluctuation amount of said printing rate.

7. A control method of controlling a cooling fan, said cooling fan controls a temperature of a thermal head, said thermal head prints an image on a recording material by driving a heating element based on image data, said control method comprising the steps of:

determining a printing rate from said image data;

predicting a temperature in each recording position in which a heating element of said thermal head and said recording material are contacted with each other, based on said printing rate; and controlling an air amount of said cooling fan based on said predicted temperature.

8. A control method of a cooling fan as claimed in claim 7, further comprising the steps of:

measuring a temperature of said thermal head;

measuring a temperature of the environment in which said thermal head is placed; and wherein said predicted temperature is determined in consideration of said head temperature and said environmental temperature in said temperature predicting step.

9. A control method of a cooling fan as claimed in claim 8, wherein said temperature predicting step comprises the steps of:

determining a rising amount of a temperature of said thermal head from said printing rate and said head temperature in reference to a first data table;

determining a dropping amount of a temperature of said thermal head from a difference and said air amount of said cooling fan in reference to a second data table, said difference being between said head temperature and said environmental temperature; and predicting said temperature in each of said recording positions based on said rising and dropping amounts.

10. A control method of a cooling fan as claimed in claim 9, wherein the controlling step of said air amount comprises the steps of determining the delay time of a heat transmitting system and a measuring system from a fluctuation amount of said printing rate in reference to a third data table; and determining said air amount in each of said recording positions based on said predicted temperature and said delay time.

11. A control method of a cooling fan as claimed in claim 8, wherein said temperature predicting step comprises the steps of:

calculating a rising amount of a temperature of said thermal head from said printing rate and said head temperature by performing a first operational equation;

calculating a dropping amount of a temperature of said thermal head from the difference between said head temperature and said environmental temperature and said air amount of said cooling fan by performing a second operational equation; and predicting said temperature in each of said recording positions based on said rising and dropping amounts.

12. A control method of a cooling fan as claimed in claim 11, wherein the controlling step of said air amount comprises the steps of calculating the delay time of a heat transmitting system and a measuring system from a fluctuation amount of said printing rate by performing a third operational equation; and determining said air amount in each of said recording positions based on said predicted temperature and said delay time.

* * * * *